United States Patent [19]

Paterson et al.

[11] 4,248,700

[45] Feb. 3, 1981

[54] TRANSIT MATERIALS SEPARATOR

[75] Inventors: Malcolm M. Paterson, Lee, N.H.; Bela M. Fabuss, Winchester, Mass.

[73] Assignee: Raytheon Company, Lexington, Mass.

[21] Appl. No.: 29,811

[22] Filed: Apr. 13, 1979

[51] Int. Cl.[3] ..... B03C 1/22; B03C 1/24

[52] U.S. Cl. ..... 209/212; 209/216; 209/227

[58] Field of Search ..... 209/212, 214, 216, 218, 209/223 R, 227

[56] References Cited

U.S. PATENT DOCUMENTS

| | | | |
|---|---|---|---|
| 278,976 | 6/1883 | Viger | 209/231 |
| 2,609,925 | 9/1952 | Weisz | 209/2 |
| 4,003,830 | 1/1977 | Schloemann | 209/212 X |
| 4,029,573 | 6/1977 | Theodore et al. | 209/212 |
| 4,127,477 | 11/1978 | Schloemann | 209/212 X |
| 4,137,156 | 1/1979 | Morey et al. | 209/227 X |

*Primary Examiner*—Ralph J. Hill

*Attorney, Agent, or Firm*—John T. Meaney; Joseph D. Pannone

[57] ABSTRACT

A materials separator apparatus comprising a stacked array of horizontally oriented and vertically spaced separator stages, which may be interconnected by a material conductor disposed for receiving commingled materials from an upper stage and feeding it to an input portion of a lower stage, each stage including a vibrating, endless belt supported for carrying a stream of commingled materials longitudinally over a steady-state magnetic array of spatially alternating, oppositely polarized magnets disposed substantially parallel to one another and extended transversely at an oblique angle to the stream whereby electrically conductive items of nonferromagnetic material passing over the magnetic array are deflected laterally out of the stream, the materials remaining in the stream may be discharged from the belt by passing them over a roller which may be magnetized for segregating dielectric nonferromagnetic material from ferromagnetic material.

15 Claims, 5 Drawing Figures

TRANSIT MATERIALS SEPARATOR

BACKGROUND OF THE INVENTION

1. Field of the Invention

This invention relates generally to material separator apparatus and is concerned more particularly with a space-saving, material separator apparatus having a plurality of interconnected separator stages.

2. Discussion of the Prior Art

In the recycling of waste material, solid municipal waste initially may be shredded and then air classified to separate the light fraction from the heavy fraction. The heavy fraction may be conveyed in a stream through a conventional magnetic separator for removal of ferromagnetic materials, such as nickel, iron, and cobalt, for examples. Thus, the stream of waste materials emerging from the magnetic separator is made up predominantly of nonferromagnetic materials which includes dielectric nonferromagnetic materials, such as plastic, rubber, and glass, for examples, as well as electrically conductive nonferromagnetic materials, such as aluminum, silver, copper, zinc, and the like.

Market analysis indicates that there is a greater demand for the electrically conductive, nonferromagnetic metals than for the other components of the heavy fraction. Consequently, although constituting only about one percent by weight of typical municipal waste, the nonferromagnetic metals nevertheless represent a significant percentage of the total resale value of recycled municipal waste. Accordingly, prior art means have been developed for separating electrically conductive items of nonferromagnetic material from the dielectric items of nonferromagnetic material in the stream emerging from the magnetic separator.

For example, U.S. Pat No. 4,003,803 granted to E. Schloemann on Jan. 18, 1977 and assigned to the assignee of this invention discloses a materials separator apparatus comprising an inclined plane having a nonmagnetic surface layer down which nonferromagnetic material slides in a stream. Disposed beneath the nonmagnetic surface layer is a steady-state magnetic series of alternate north and south poles which are substantially parallel to one another and extend at an oblique angle across the stream. As a result, electrically conductive items of nonferromagnetic material in the stream pass sequentially through a spatially alternating array of oppositely directed magnetic fields which induce eddy currents in the electrically conductive items of nonferromagnetic material. The eddy-currents coact with the magnetic fields to exert on the electrically conductive items resultant forces directed upwardly of the inclined plane and perpendicular to the angulated magnetic poles of the array. Consequently, the resultant forces have respective laterally directed components which cause the items to move laterally out of the stream while sliding longitudinally down the inclined plane. Thus, the electrically conductive items deflected laterally out of the stream are separated from the dielectric items of nonferromagnetic material in the stream.

The resultant force exerted on the electrically conductive items of nonferromagnetic material also have respective longitudinal components which are directed upwardly of the inclined plane and, consequently, may be referred to as "decelerating" force components. These decelerating force components may be rendered substantially insignificant in comparison with the force of gravity acting on the electrically conductive items by disposing the inclined plane at a suitable angle, such as greater than thirty degrees, for example, with respect to the horizontal base of the separator. Accordingly, the steeper the angle of the inclined plane, in combination with a preceding magnetic separator disposed above it to feed nonferromagnetic material onto the upper end portion of the inclined plane, the higher the resulting structure.

It may be found that one pass of the nonferromagnetic material down the inclined plane does not provide a sufficiently high separation rate of "concentrate", that is, solely electrically conductive items of nonferromagnetic material, from the "tailings", that is, solely dielectric items of nonferromagnetic material. Consequently, as shown in U.S. Pat. No. 4,029,573 granted to Theodore et al and assigned to the assignee of the invention, a second inclined plane may be disposed beneath the first inclined plane for receiving the "middlings", that is, a mixture of electrically conductive items and dielectric items of nonferromagnetic material, therefrom and reprocessing it as described. As a result, still more electrically conductive items of the nonferromagnetic material are separated from the stream, after passage of the "middlings" down the second inclined plane. However, the required slope of the second inclined plane to render the "decelerating" force components insignificant in comparison with the force of gravity increases the height of the required structure still further.

Also, it may be found that the conventional magnetic separator preceding the first inclined plane is not sufficiently strong magnetically to remove dust-size particles of ferromagnetic material from the stream. As a result, these ferromagnetic particles adhere to the smooth surface of the first inclined plane due to the attractive force exerted by the underlying magnetic array. Accordingly, the adhering ferromagnetic particles interfere with nonferromagnetic material sliding down the inclined plane, and with the lateral deflection of electrically conductive items out of the stream. Consequently, to avoid periodically cleaning the smooth surface of the inclined plane, it is necessary to provide the magnetic separator with a second magnet which is sufficiently strong to remove the dust-size particles of ferromagnetic material before they reach the first inclined plane.

Therefore, it is advantageous and desirable to provide a space-saving, materials separator apparatus with a plurality of separator stages for achieving a high separation rate of electrically conductive items from a stream of nonferromagnetic materials, and which is not adversely affected by ferromagnetic particles in the stream.

SUMMARY OF THE INVENTION

Accordingly, this invention provides a materials separator apparatus for segregating electrically conductive items of nonferromagnetic material from a stream of commingled materials, which may include ferromagnetic material. The apparatus includes a horizontally oriented and substantially planar separator stage provided with feeder means for directing commingled materials into an egressing stream. The separator stage includes guide means comprising a vibrating endless belt having a preferably low friction surface disposed for receiving the stream of commingled materials egressing from the feeder means, and connected to a variable speed drive means for moving the belt longitudinally along a predetermined path. The belt carries the stream of commingled materials longitudinally over a steady-state magnetic means comprising an alternating array of oppositely polarized, steady-state magnets disposed substantially parallel with one another and extended transversely at an oblique angle to the centerline of the belt.

The magnetic array is disposed adjacent the under surface of the belt for establishing in the path of the stream a steady-state, spatially alternating series of oppositely directed magnetic fields which are substantially parallel to one another and extend transversely at an oblique angle to the stream. Consequently, the commingled materials in the stream are carried by the belt sequentially through the spatially alternating array of oppositely directed mangetic fields and cut the flux lines associated therewith. The dielectric items of nonferromagnetic material are unaffected by the magnetic fields; and any items of ferromagnetic material in the stream adhere to the belt due to the attractive force exerted by the underlying magnets of the array. However, the electrically conductive items of nonferromagnetic material have induced therein eddy-currents which coact with the magnetic fields to exert on these items respective resultant forces.

In accordance with Lenz's Law, the resultant forces are directed oppositely to the direction of belt movement and perpendicularly to the magnets of the array. Consequently, each of the resultant forces may be resolved into two components, one a decelerating component directed longitudinally along the belt in the direction opposite to the movement of the belt and the other a deflecting component directed laterally of the belt toward a longitudinal edge thereof. The decelerating component may be rendered insignificant by adjusting the variable drive means to provide the belt with a velocity much greater in magnitude than the magnitude of the decelerating component. However, the deflecting components of the resultant forces are significant and cause the electrically conductive items of nonferromagnetic material to travel angularly out of the stream to an output portion of the separator stage. The commingled materials remaining in the stream are carried by the belt to a discharge portion of the separator stage where magnetic separator means may be provided for segregating any items of ferromagnetic material in the stream from dielectric items of nonferromagnetic material.

BRIEF DESCRIPTION OF THE DRAWINGS

For a better understanding of this invention, reference is made in the following detailed description to the accompanying drawings wherein.

DESCRIPTION OF THE PREFERRED EMBODIMENTS

Figure 1:
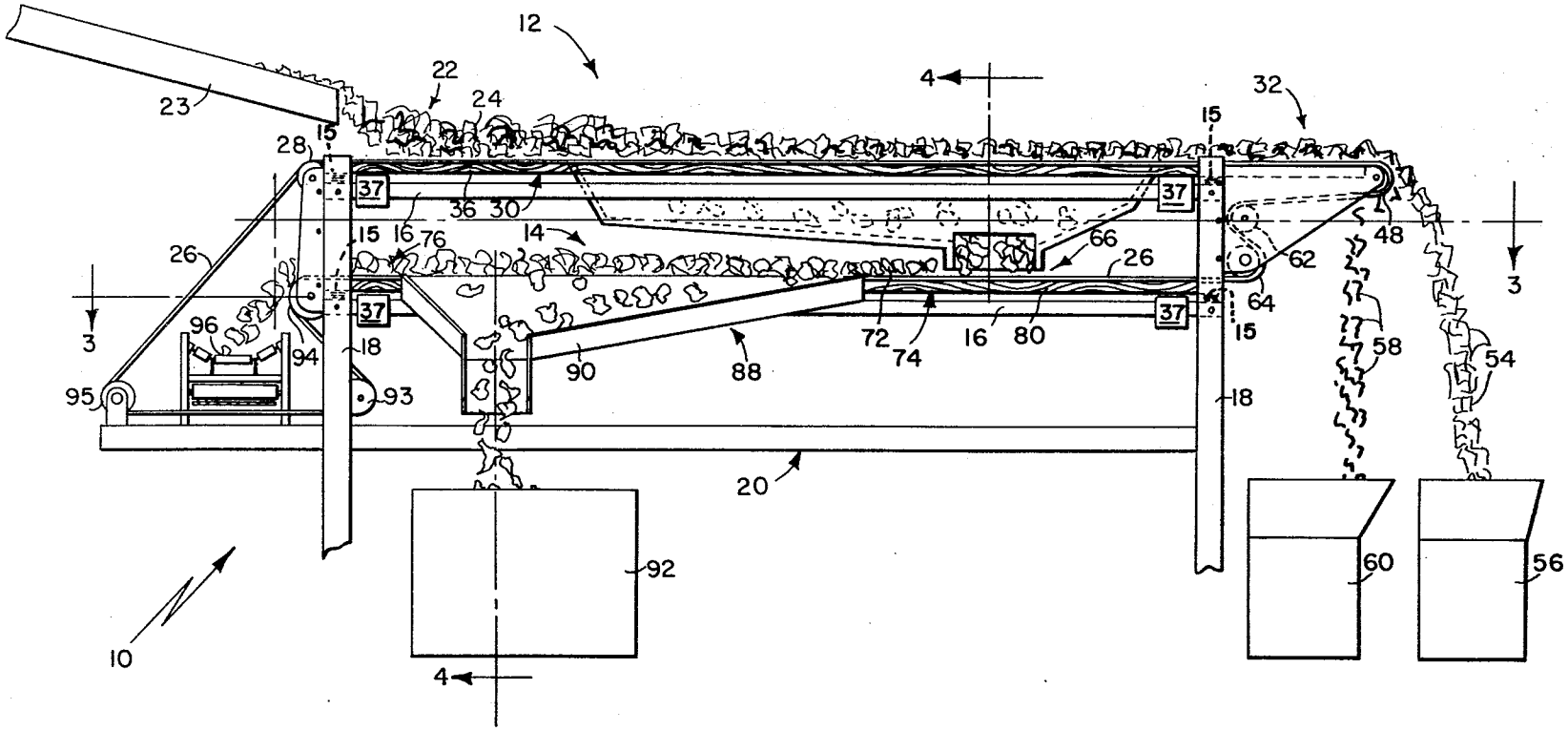
FIG. 1 is a schematic elevational view of a materials separator apparatus embodying the invention.

Referring to the drawings wherein like characters of reference designate like parts, FIG. 1 shows a materials separator apparatus 10 comprising a stacked array of horizontally oriented and substantially planar separator stages, 12 and 14, respectively, which are vertically spaced apart. Each of the separator stages 12 and 14 is supported resiliently by respective vibrational isolating means comprising a plurality of spaced coil springs 15 disposed upright between the separator stage and underlying cross-beams 16. The cross-beams 16 have respective opposing end portions affixed to suitably spaced columns 18 for forming a lattice-like support structure 20, which is made of rigid material, such as wood or steel, for examples.

The upper stage 12 includes an input end portion 22 having material feeder means comprising a downwardly inclined chute 23 wherein commingled materials may be deposited from a suitable source, such as a conventional magnetic separator (not shown), for example. Chute 23 is made of nonmagnetic material, such as austenitic steel, for example, and is disposed for directing the deposited commingled materials into a stream 24 egressing from the lower end portion thereof. The stream 24 flows onto a low friction surface of an endless belt 26 passing around an idler roller 28 and beneath the lower end portion of chute 23. Belt 26 is made of flexible, nonmagnetic material, such as polytetrafluorethylene, for example, and constitutes guide means for directing the stream 24 along a predetermined path. The stream 24 is carried longitudinally by the belt 26 over a steady-state magnetic means 30 and to a discharge portion 32 of the separator stage 12.

Figure 2:
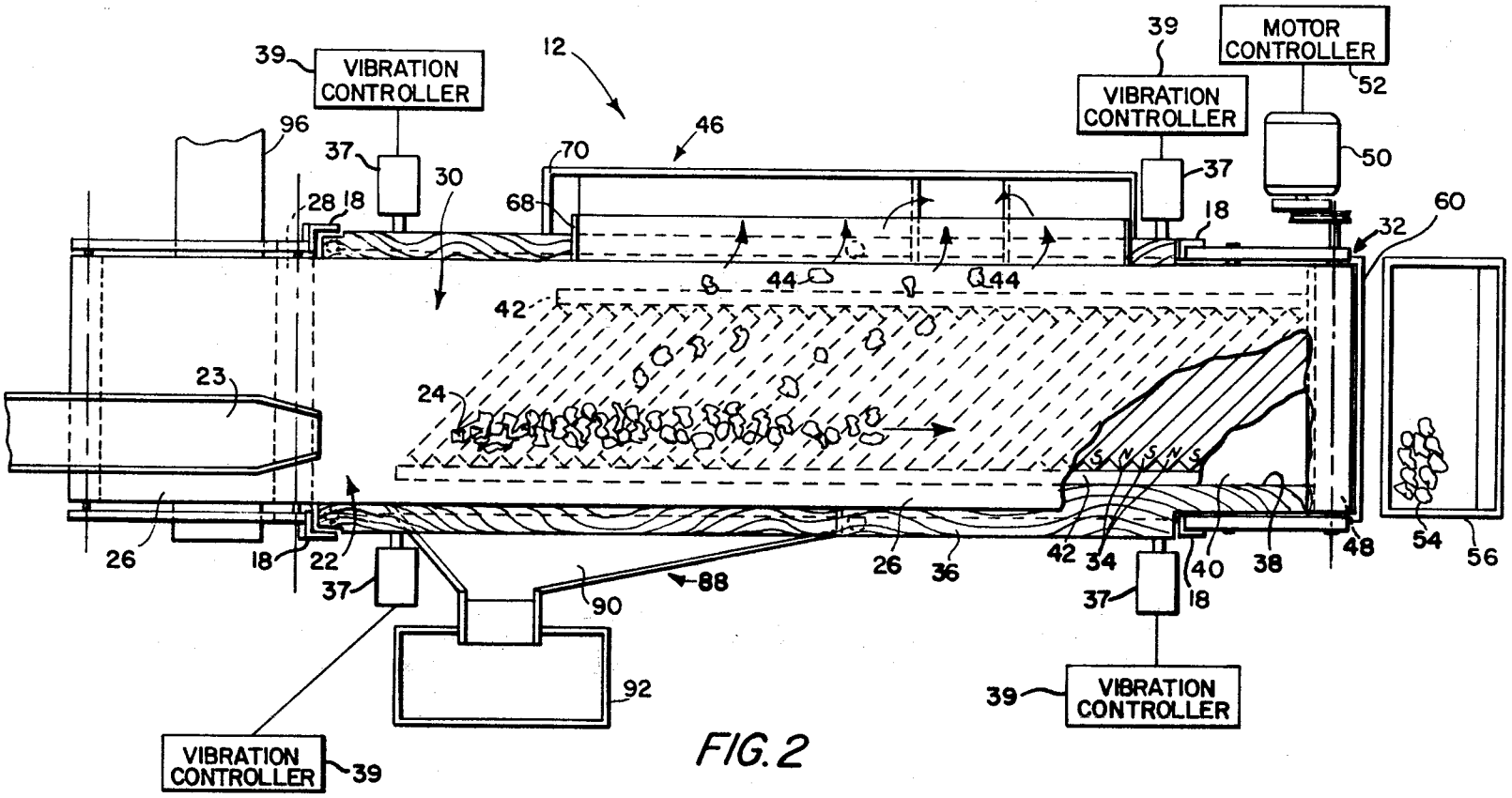
FIG. 2 is a plan view of the apparatus shown in FIG. 1.

As shown in FIG. 2, the steady-state magnetic means 30 comprises an alternating array of oppositely polarized, steady-state magnets 34 which are disposed substantially parallel to one another and extend transversely at an oblique angle to the longitudinal centerline of belt 26. Thus, each of the magnets 34 may be of the permanent type or may be of the electromagnetic type energized from a source of unidirectional current (not shown). A suitable magnet of the permanent type may comprise a bar magnet having a uniform magnetic pole adjacent belt 26, or may comprise a plurality of smaller size magnets, such as domino-size, for example, diposed to provide a composite magnetic pole adjacent belt 26 similar to the uniform magnetic pole provided by the bar magnet.

The array of steady-state magnets 34 may be maintained in a plane immediately below the belt 26 by a substantially planar support member 36 made of rigid nonmagnetic material, such as wood, for example. Support member 36 extends from the input portion 22 to the discharge portion 32 of separator stage 12, and has edge portions spaced laterally from adjacent columns 18 of the lattice-like support structure 20. The member 36 is resiliently supported by the vibrational isolating means comprising a plurality of spaced coil springs 15 having respective upper end portions secured to the member 36 and respective lower end portions attached to underlying cross-beams 16 of structure 20. Marginal portions of the support member 36 are attached to respective arms protruding from spaced vibrators 37, which may be of the solenoid type energized with oscillatory current, for example. The vibrators 37 are connected electrically to respective adjustable vibration controller units 39 for regulating the vibrational movement of support member 36. Thus, vibrations of the resiliently supported member 36 are resonantly transmitted to the overlying belt 26, but are not readily transmitted to the underlying cross-beams 16 of support structure 20 due to the damping effect of the interposed coil springs 15.

Disposed in the upper surface of support member 36 is a suitably configured recess 38 having disposed therein the array of magnets 34. The bottom surface of recess 38 preferably is lined with a sheet 40 of low reluctance, magnetic material, such as mild steel, for example, which provides return paths for magnetic flux emanating from the poles of magnets 34 remote from the belt 26. Thus, the magnets 34 adhere magnetically to the sheet 40 and need not require mechanical retaining means, such as bonding cement, for example, to hold the magnets 34 in place. However, a bonding cement, such as epoxy resin, for example, may be used for holding the magnets 34 in place, if desired. Longitudinal marginal portions of the recess 38 preferably have disposed therein respective "keeper" bars 42 made of low reluctance material, such as mild steel, for example, to provide return paths for any magnetic flux emanating from respective end portions of the magnets 34 and extending toward the adjacent longitudinal edge of the support member 36. The magnets 34 and keeper bars 42 preferably are provided with suitable thicknesses for being substantially flush with the surface of support member 36 adjacent the belt 26.

Thus, the steady-state magnetic means 30 is disposed for establishing above the belt 26 and in the path of stream 24 a spatially alternating series of oppositely directed and substantially parallel magnetic fields which extend transversely at an oblique angle to the stream 24. As a result, the commingled materials in stream 24 are carried by the belt 26 sequentially through the magnetic fields, and cut the associated magnetic lines of flux. Consequently, electrically conductive items 44 of nonferromagnetic material in stream 24 have induced in them eddy-currents which react with the magnetic fields to exert on the items 44 respective resultant forces. In accordance with Lenz' Law, the resultant forces are directed oppositely to the movement of belt 26 and perpendicularly to the angularly extending magnets 34 of the array.

Accordingly, each of the resultant forces may be resolved into two components, one a decelerating component directed longitudinally along belt 26 in the direction opposite to the direction of belt movement, and the other a deflecting component directed laterally of belt 26. The velocity of belt 26 preferably is adjusted to a value which renders the decelerating components of the resultant forces insignificant. However, the deflecting components of the resultant forces are significant and cause the items 44 to move laterally out of stream 24 while being carried longitudinally of stage 12 by the belt 26. As a result, the electrically conductive items 44 of nonferromagnetic material travel angularly out of stream 24 and off a longitudinal edge of belt 26 to enter an output portion 46 of stage 12.

On the other hand, the dielectric, nonferromagnetic materials in stream 24 are unaffected by the cutting of the lines of magnetic flux. Also, any ferromagnetic material in stream 24 adheres to the surface of belt 26 due to the magnetic attractive forces exerted on this material by the underlying magnets 34 of the array. Consequently, the dielectric nonferromagnetic materials and any ferromagnetic material in stream 24 are carried by belt 26 longitudinally toward the discharge portion 32 of separator stage 12. It has been found that particles of ferromagnetic material in stream 24 may travel obliquely along a particular magnet 34 of the array. However, when these ferromagnetic particles reach a keeper bar 42, they are carried by the belt 26 along the keeper bar and toward the discharge portion 32 of stage 12.

In the discharge portion 32 of stage 12, the belt 26 carries the stream 24 longitudinally onto a drive roller 48 which is suitably coupled, as by intermeshing gears, for example, to a rotatable shaft of a drive motor 50. The motor 50 is electrically connected to a control unit 52 having adjustable means, such as a potentiometer (not shown), for example, for varying the rotational speed of motor 50 and thereby regulating the longitudinal velocity of belt 26. Drive roller 48 is of the magnetic separator type having alternating semi-cylindrical portions of its periphery comprising respective north and south poles.

It has been found that the belt 26 readily carries the dielectric, nonferromagnetic materials in the stream from the steady-state magnetic means 30 to the roller 48, dut does not readily move ferromagnetic material from the adjacent end portion of the array of magnets 34 without the aid of a magnetic attractive force. Accordingly, the planar support member 36 and the array of magnets 34 are terminated sufficiently close to the periphery of roller 48 for the magnetic poles thereof to assist the belt 26 in moving ferromagnetic material from the steady-state magnetic means 30 to the roller 48. When the belt 26 carries the stream 24 of commingled materials around roller 48, the dielectric items 54 of nonferromagnetic material in the stream are unaffected by the magnetic attractive forces exerted by the magnetic poles of roller 48 and fall tangentially therefrom into a suitably positioned receptacle 56. On the other hand, items 58 of ferromagnetic material in stream 24 adhere magnetically to the belt 26 until carried sufficiently beyond the roller 48 for the force of gravity to overcome the magnetic attractive forces and cause the items 58 of ferromagnetic material to drop into a suitably positioned receptacle 60. Subsequently the belt 26 may pass around an idler roller 62 and then an idler roller 64 to pass longitudinally through an input portion 66 of the lower separator stage 14.

Figure 4:
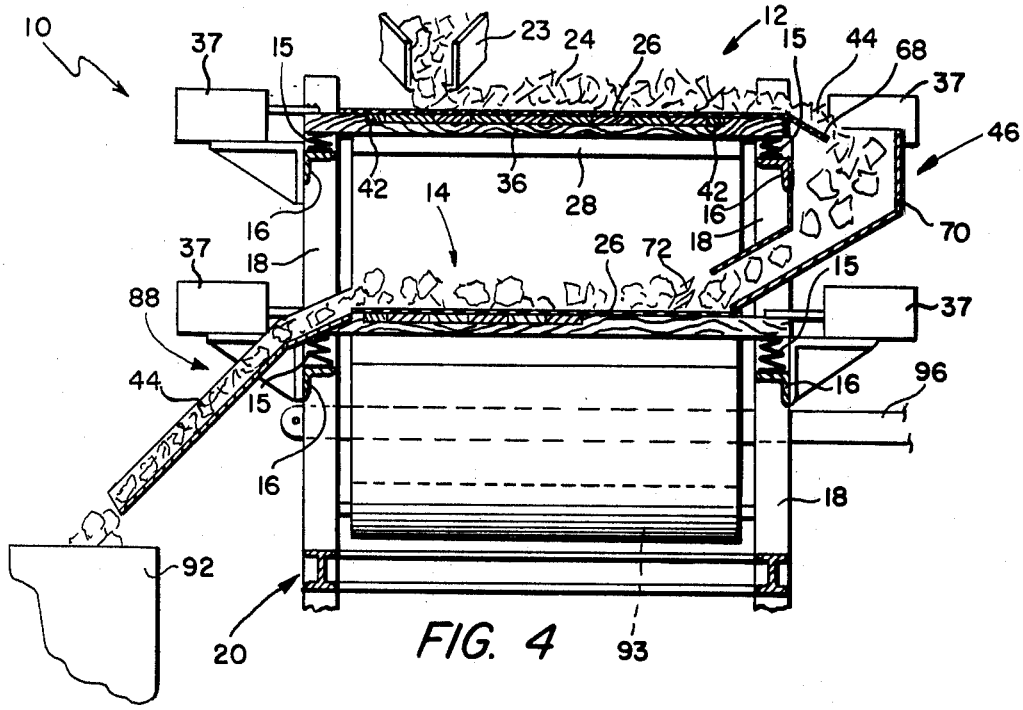
FIG. 4 is a cross-sectional view taken along the line 4—4 shown in FIG. 1 and looking in the direction of the arrows.

As shown in FIG. 4, the output portion 46 of upper separator stage 12 may include a guide strip 68 secured to the adjacent marginal portion of planar support member 36 and made of nonmagnetic material, such as austenitic steel, for example. The guide strip 68 is inclined downwardly and extends into an elongated, open end of a hopper 70 for directing therein the electrically conductive items 44 deflected laterally out of stream 24 and other materials which may fall or be carried off the adjacent longitudinal edge portion of belt 26. Hopper 70 is made of suitable material, such as sheet steel, for example, and preferably has a suitably contoured, lower end portion disposed for feeding an egressing stream 72 of the deposited commingled materials into the input portion 66 of lower separator stage 14.

Figure 3:
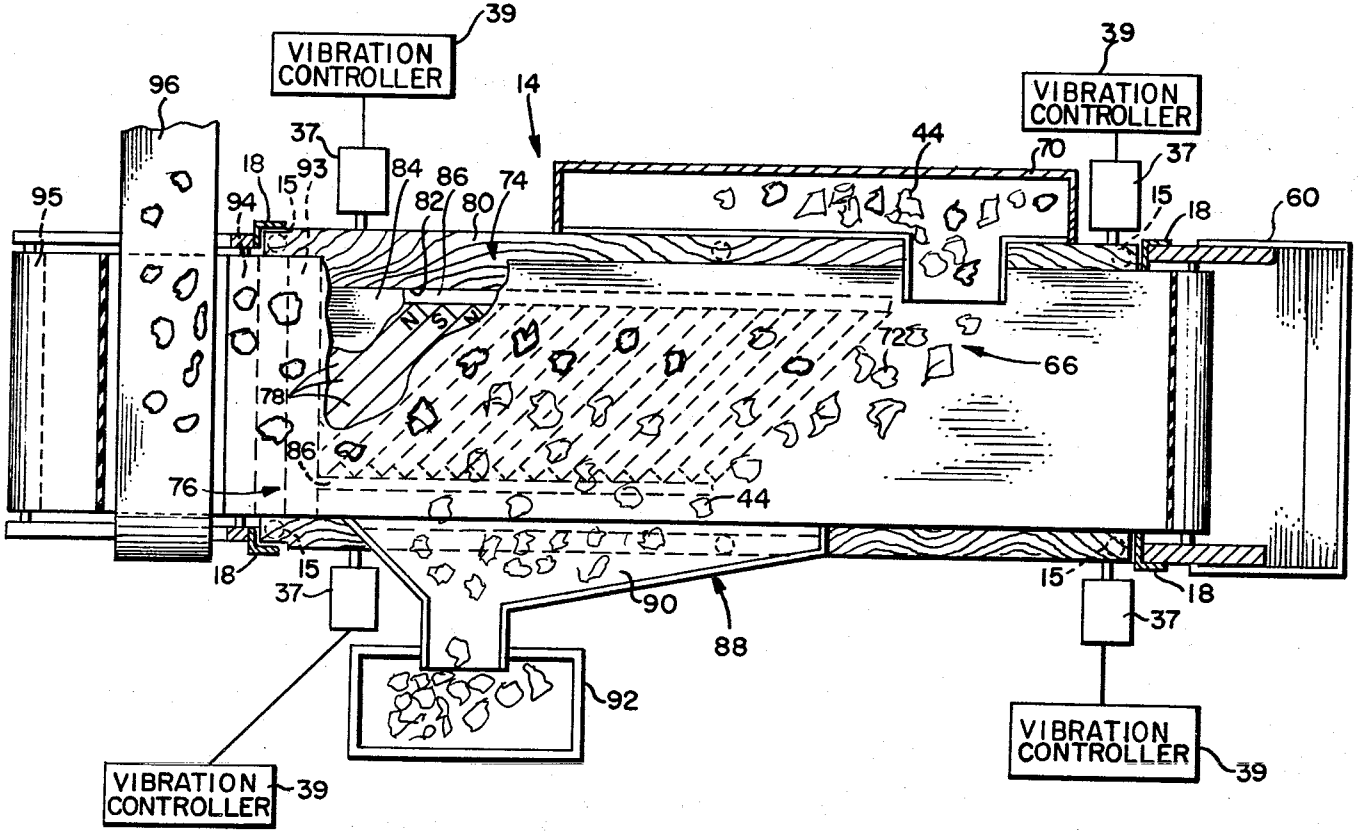
FIG. 3 is a transverse view taken along the line 3—3 shown in FIG. 1 and looking in the direction of the arrows.

As shown in FIG. 3, the lower separator stage14 is similar to the upper separator stage 12 and includes input portion 66 provided with material feeder means comprising the lower end portion of hopper 70. The stream 72 of commingled materials flows onto a low friction surface of endless belt 26 which constitutes a guide means for directing the stream 72 along a predetermined path. Stream 72 is carried by belt 26 longitudinally over a steady-state magnetic means 74 and to a discharge portion 76 of separator stage 14. The magnetic means 74 comprises an alternating array of oppositely polarized, steady-state magnets 78 which are disposed substantially parallel to one another and extend transversely at an oblique angle to the longitudinal centerline of belt 26.

The array of magnets 78 may be maintained in a plane immediately below belt 26 by a substantially planar support member 80 made of rigid nonmagnetic material, such as wood, for example, and extending from input portion 66 to discharge portion 76 of stage 14. Support member 80 also is resilently supported by vibrational isolating means comprising a plurality of spaced coil springs 15, and has marginal portions attached to respective arms protruding from spaced vibrators 37. The vibrators 37 are connected electrically to respective adjustable vibration controller units 39 for regulating the vibrational movement of support member 80, which is transmitted resonantly to the belt 26 in stage 14. A surface of support member 80 adjacent belt 26 is provided with a suitably configured recess 82 having a bottom surface lined with a sheet 82 of low reluctance material whereon the array of magnets 78 is disposed between longitudinally extending, keeper bars 86.

Thus, the steady-state magnetic means establishes above the belt 26 and in the path of stream 72 a spatially alternating series of oppositely directed magnetic fields disposed substantially parallel to one another and extended transversely at an oblique angle to the stream 72. As a result, the commingled materials in stream 72 are carried by the belt 26 sequentially through the magnetic fields, and cut the associated magnetic lines of flux. Consequently, the electrically conductive items 44 in stream 72 have induced in them eddy-currents which coact with the magnetic fields to exert on the items 44 respective resultant forces. Again, in accordance with Lenz's Law, the resultant forces are directed oppositely to the direction of belt movement and perpendicularly to the magnets 78 of the array.

However, in this instance, the belt 26 is moving oppositely to the direction of belt movement in stage 12. Accordingly, each of the resultant forces developed in stage 14 may be resolved into two components. One of the components is the decelerating component which is directed longitudinally of belt 26 and oppositely to the direction of belt movement. This decelerating component is directly opposite to the equivalent decelerating component developed in stage 12 and also is rendered insignificant by the velocity of belt 26 in stage 14. The other component is the deflecting component which is directly laterally of belt 26 and toward the opposite longitudinal edge thereof as compared to the equivalent deflecting component developed in stage 14. This deflecting component also is significant and causes the asociated item 44 to move laterally out of stream 72 while being carried longitudinally of the stream by the belt 26 in stage 14.

Consequently, the electrically conductive items 44 travel angularly out of stream 72 and toward an output portion 88 adjacent the longitudinal edge of steady-state magnetic means 74, while the commingled materials of stream 72 are carried longitudinally by belt 26 toward the discharge portion 76. The output portion 88 may include a ramp 90 made of suitable material, such as sheet steel, for example, and sloped downwardly for feeding the items 44 separated from stream 72 into a suitably disposed receptacle 92. In the discharge portion 76 of separator stage 14, the commingled materials remaining in stream 72 are carried by the belt 26 from the steady-state magnetic means 74 to a roller 94, which may be of the conventional idler type. Accordingly, these commingled materials are carried around the roller 94 and drop tangentially therefrom onto a suitable endless belt 96 moving transversely with respect to the movement of belt 26. After passing around idler roller 94, the belt 26 may be routed around change-of-direction rollers, 93 and 95, respectively, to return to the idler roller 28 beneath chute 23.

Figure 5:
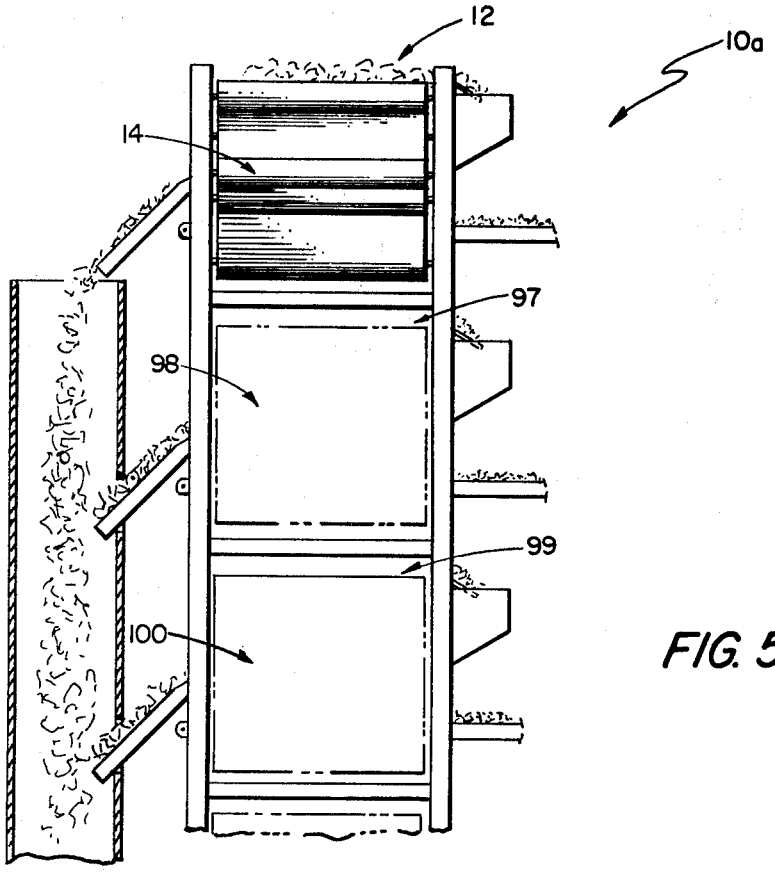
FIG. 5 is a schematic elevational view of an alternative embodiment of the invention.

Thus, in stage 14, the electrically conductive items 44 are segregated a second time from commingled materials to obtain a higher grade of separation than provided by separator stage 12 alone. As shown in FIG. 5, the apparatus 10 may include other separator stages, such as 97–100, respectively, stacked below separator stage 14 and functioning in a similar manner to separate the electrically conductive items 44 from commingled materials and provide a correspondingly higher grade of separation. Alternatively, some of the separator stages 97–100 may be utilized for segregating any electrically conductive items from the items 54 of commingled, nonferromagnetic materials in receptacle 56 and thereby provide a higher percentage of separation.

It may be seen from a comparison of the stacked array of separator stages shown in FIG. 5 with the inclined ramp-type separator shown in U.S. Pat. No. 4,003,830 that approximately three of the horizontally oriented separator stages, such as 12, 14, and 97, for example, may be disposed in the vertically equivalent space occupied by one of the ramp-type separators, and will provide a higher grade of separation or a higher percentage of separation or both. Similarly, it may be seen from a comparison of the stacked array of separator stages shown in FIG. 5 with the coupled upper and lower ramp-type separator disclosed in U.S. Pat. No. 4,029,573 that approximately six of the horizontally oriented separator stages, such as 12, 14, and 97–100, for example, may be disposed in the vertically equivalent spaced occupied by the coupled pairs of ramp-type separators. Also, a horizontally oriented separator stage, such as 12, for example, will not be adversely affected by ferromagnetic material being in the stream of imput commingled materials, as will the ramp-type separators shown in the referenced patents.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in any limiting sense.

What is claimed is:

1. A materials separator apparatus for segregating electrically conductive items of nonferromagnetic material from commingled materials and comprising:

a stacked array of horizontally oriented and vertically spaced, upper and lower separator stages each of the stages having input feeder means disposed for receiving commingled materials including electrically conductive items of non-ferromagnetic material and directing them into an egressing stream, guide means disposed adjacent the input feeder means for receiving therefrom the egressing stream and directing it longitudinally along a horizontally oriented path, and steady-state magnetic means disposed adjacent the path to establish therein a spatially alternating series of oppositely directed and substantially parallel magnetic fields transversely at an oblique angle to the stream;

material conductive means having respective portions disposed adjacent the upper and lower separator stages for directing materials from the upper separator stage to the input feeder means of the lower separator stage; and magnetic separator means disposed adjacent a portion of the path beyond the steady-state magnetic means of the upper separator stage for removing ferromagnetic material from the residual commingled materials in the stream.

2. A materials separator apparatus as set forth in claim 1 wherein the guide means in the upper separator stage includes output means disposed along the path for receiving materials deflected laterally from the stream.

3. A materials separator apparatus as set forth in claim 2 wherein the material conductive means is disposed adjacent the output means of the upper separator stage for receiving materials laterally deflected from the stream and directing them to the input means of the lower separator stage.

4. A materials separator as set forth in claim 1 wherein the guide means in the upper stage includes a vibrating endless belt having a surface portion disposed adjacent the input means for receiving thereon the egressing stream of commingled materials.

5. A materials separator apparatus as set forth in claim 1 wherein the guide means in the upper and lower stages comprises a continuous belt movably supported for travelling longitudinally over the steady-state magnetic means in the upper stage and then over the steady-state magnetic means in the lower stage.

6. A materials separator apparatus for segregating electrically conductive items of nonferromagnetic material from commingled materials and comprising:

input means disposed for producing an egressing stream of the commingled materials including electrically conductive items of nonferromagnetic material;

guide means disposed adjacent the input means for receiving therefrom the egressing stream and directing it longitudinally along a horizontally oriented path;

steady-state magnetic means disposed adjacent the path to establish therein a spatially alternating series of oppositely directed and substantially parallel magnetic fields transversely at an oblique angle to the stream for inducing eddy-currents in the electrically conductive items of nonferromagnetic material and producing force components which deflect the items laterally out of the stream; and magnetic separator means disposed adjacent a portion of the path beyond the steady-state magnetic means for removing ferromagnetic material from the residual commingled materials in the stream.

7. A materials separator apparatus as set forth in claim 6 wherein the guide means includes an endless belt having a portion disposed for receiving thereon the egressing stream of commingled materials and extended longitudinally along the horizontally oriented path.

8. A materials separator apparatus as set forth in claim 7 wherein the magnetic separator means includes rotatable support means coupled to the belt for directing ferromagnetic material and other residual commingled materials in the stream along respective different paths.

9. A material separator apparatus as set forth in claim 8 wherein the guide means includes drive means coupled to the rotatable support means for moving the belt longitudinally along the path in the direction of the magnetic fields and carrying the commingled materials sequentially through the magnetic fields.

10. A material separator apparatus as set forth in claim 9 wherein the guide means includes drive control means coupled to the drive means for regulating the velocity of the commingled materials carried sequentially through the magnetic fields.

11. A materials separator apparatus as set forth in claim 5 wherein the steady-state magnetic means comprises an alternating array of oppositely polarized and substantially parallel, steady-state magnets disposed transversely at an oblique angle to the path.

12. A materials separator apparatus as set forth in claim 11 wherein the steady-state magnetic means includes a horizontally oriented and substantially planar support member underlying the path and substantially parallel thereto.

13. A materials separator apparatus as set forth in claim 12 wherein the planar support member is provided with a recess wherein the array of steady-state magnets is disposed in substantially parallel relationship with the path.

14. A materials separator apparatus as set forth in claim 13 wherein the planar support member is made of rigid non-magnetic material, and the recess is lined with low reluctance material.

15. A materials separator apparatus as set forth in claim 13 wherein the guide means includes vibrating means coupled through the planar support member to the belt for resonantly vibrating the belt.

* * * * *

UNITED STATES PATENT AND TRADEMARK OFFICE

CERTIFICATE OF CORRECTION

PATENT NO. : 4,248,700

DATED : February 3, 1981

INVENTOR(S) : Malcolm M. Paterson et al.

It is certified that error appears in the above—identified patent and that said Letters Patent is hereby corrected as shown below:

Column 1, line 36, "4,003,803" should read -- 4,003,830 --.

Column 7, line 24, "82" should read -- 84 --.

Column 8, line 43, "spaced" should read -- space --.

Signed and Sealed this

*Ninth* Day of *June 1981*

[SEAL]

*Attest:*

RENE D. TEGTMEYER

*Attesting Officer* *Acting Commissioner of Patents and Trademarks*